US005421286A

United States Patent [19]

McLean

[11] Patent Number: 5,421,286

[45] Date of Patent: Jun. 6, 1995

[54] DISPOSABLE SHAVER WITH COUNTER AND METHOD OF COUNTING AND QUANTITATIVELY COMPARING THE USEFUL LIFE OF DISPOSABLE SHAVERS

[76] Inventor: Scott McLean, 800 Wakefield, Bowling Green, Ky. 42103

[21] Appl. No.: 27,107

[22] Filed: Mar. 5, 1993

[51] Int. Cl.[6] ..... B26B 19/38

[52] U.S. Cl. ..... 116/201; 30/41.7; 116/200; 116/307

[58] Field of Search ..... 30/41.7; 116/307, 328, 116/327, 205, 279, DIG. 8, DIG. 28, 200, 201; 206/459.1

[56] References Cited

U.S. PATENT DOCUMENTS

| | | | |
|---|---|---|---|
| 3,137,939 | 6/1964 | Waldeck | 30/41.7 |
| 3,213,269 | 10/1965 | Melvin et al. | 116/DIG. 28 X |
| 3,229,659 | 1/1966 | Sciascia | 30/41.7 X |
| 3,392,468 | 7/1968 | Wolf | 206/459.1 X |
| 3,618,563 | 1/1970 | Singer | 116/133 |
| 3,648,647 | 3/1972 | Joy | 116/205 |
| 3,974,916 | 8/1976 | Bartolucci | 206/459.1 |
| 4,208,984 | 6/1980 | Glanzman | 30/41.7 X |
| 4,268,958 | 5/1981 | Hilbert | 30/41.7 |
| 5,062,209 | 11/1991 | Rais | 30/41.7 |
| 5,119,557 | 6/1992 | Kaiko | 30/41.7 |

*Primary Examiner*—Rinaldi I. Rada
*Assistant Examiner*—Clark F. Dexter
*Attorney, Agent, or Firm*—Rick R. Wascher

[57] ABSTRACT

A disposable shaver having a shaving head and handle equipped with blister bubbles positioned along the handle of the shaver. The blister bubbles are depressible from convex to concave and are provided to count the number of times the shaver is used. The method comprises the use of the inventive shaver to compute the useful life of a particular brand of disposable shaver.

18 Claims, 1 Drawing Sheet

DISPOSABLE SHAVER WITH COUNTER AND METHOD OF COUNTING AND QUANTITATIVELY COMPARING THE USEFUL LIFE OF DISPOSABLE SHAVERS

BACKGROUND OF THE INVENTION

1. Field of the Invention

The present invention relates generally to disposable shavers, but more particularly to disposable shavers having means for counting the number of shaves or the number of times a particular shaver is used.

2. Description of the Prior Art

Many shaver manufacturers market disposable shavers. Disposable shavers are popular among men and women alike. Disposable shavers come in single and dual blade designs, all of which have a handle and a shaving head portion.

The shaving head receives or holds the blade. The blade is usually sealed within the head by incapsulation, hot melt of the head material, or any other means of stabilizing the blade with respect to the head.

Some of the more popular disposable shaver designs also incorporate a pivoting or flexible head. Still others have self-cleaning mechanisms and lubrication strips associated with the shaving head. Self-cleaning shavers head designs enable the user to eject debris that becomes trapped in the shaving head in the area surrounding the blade. Lubricating strips enable the shaver head to easily glide along the surface of the skin.

The majority of disposable shavers are formed by injection molding plastic material. Plastic disposable shavers are particularly useful in wet environments such as the shower or bath. High strength plastic is preferred, however, because the handle and shaving head connection must withstand the pressure forces associated with shaving.

Each of the devices disclosed in the following list of U.S. and foreign patents is directed to a shaver having a counter.

| PATENT NUMBER | GRANTED TO |
|---|---|
| U.S. Pat. No. 5,119,557 | Kako |
| U.S. Pat. No. 5,062,209 | Rais |
| U.S. Pat. No. 4,268,958 | Hilbert |
| U.S. Pat. No. 3,618,563 | Singer |
| U.S. Pat. No. 3,229,659 | Sciascia |
| United Kingdom No. 454,943 | Marek |

The Rais device is a disposable shaver comprising a blade holder with blade, and a handle connected to the blade holder. Bendable tabs are formed along the handle, and indicia is positioned adjacent to the tabs. After each use the user bends one of the tabs downward toward the shaver handle. The number of shaves can then be recorded simply by counting the number of bent tabs, or reading the indicia adjacent thereto.

The Hilbert device comprises a disposable shaver having a plurality of frangible tabs positioned along the handle portion of the shaver. The tabs are designed to be broken off one at a time. The Hilbert shaver enables the user to keep track of the number of shaves received from a single shaver by counting the number of frangible tabs that have been removed.

The frangible tabs that are broken away from the body of the Hilbert shaver are simply thrown away. The construction of the Rais device might minimize the generation of debris, but bendable scored plastic tabs have been known to break off of similar articles.

Heretofore, a disposable shaver providing a means for counting the number of shaves received from a particular shaver such that the counting means remains associated with the body or handle of the shaver in order to prevent generation of debris, has not been invented.

Further, a method of comparing the useful life of one shaver and comparing it to the useful life of a second shaver, both incorporating the means referenced in the preceding paragraph has not been invented.

SUMMARY OF THE PRESENT INVENTION

The present invention comprises a disposable shaver having a blade holding portion, a handle, and a neck portion in communication with the head and handle. It is possible to construct the present invention in such a manner as to directly connect the handle portion to the shaving head and thereby eliminate the need for a neck region.

In the preferred embodiment of the invention, the handle has a front, a back, and sides that form either a hollow or a ribbed interior. Depressible bubbles or blisters are positioned along and formed into the handle of the shaver.

The blisters may be formed on the front, back or sides on the shaver and may be formed from an injection molding technique incorporating multiple injection sites at the bubble of the mold. The use of this technique ensures complete coverage and free flow of plastic at the bubbles. A preferred thickness of the bubble is one one-thousandth (1/1000th or 0.001) of an inch; however, a thickness up to 0.004 is possible depending on the plastic used.

The inventive blisters are a means to count the number of times a particular shaver has been used. Following each use, the user simply depresses one of the blisters. In the preferred embodiment described below, the blisters change in shape from convex to concave, and remain in this position for the remaining life of the shaver. To facilitate the depression of the blisters, it is contemplated to form a small hole in the blisters.

Optional indicia may be placed adjacent the blister means. The indicia is provided as an added means of visual confirmation of the number of times a shaver has been used.

The present invention may be used in accordance with any of the features found in the prior art disposable shavers. Accordingly, the present invention may be incorporated into disposable shavers having single and dual blade designs, pivotable shaving heads, lubrication strips, self-cleaning mechanisms, and flexible heads.

The inventive method is directed to the use of the inventive apparatus as a means to count the number of shaves obtained from a particular shaver, and quantitatively analyzing the number of shaves obtained from different brands of shavers.

Therefore, an object of the present invention is to provide a blister bubble means for counting the number of shaves obtained from a disposable shaver.

A further object and advantage of the present invention is to provide the user with a means of counting in accordance with the aforementioned object, but to prevent the generation of debris associated with tab designs of the prior art. A further object and advantage of the present invention is to enable the user of the invention to compare the useful life of shavers marketed by different manufacturers.

These and other objects and advantages of the present invention are achieved in accordance with the present invention by depressible blisters which are integrally formed on the handle of the shaver, and which are designed to prevent disassociation therefrom. The aforementioned objects and advantages will become more clear from the following detailed description with reference to the accompanying drawings.

DESCRIPTION OF TEE PREFERRED EMBODIMENT

Figure 1:
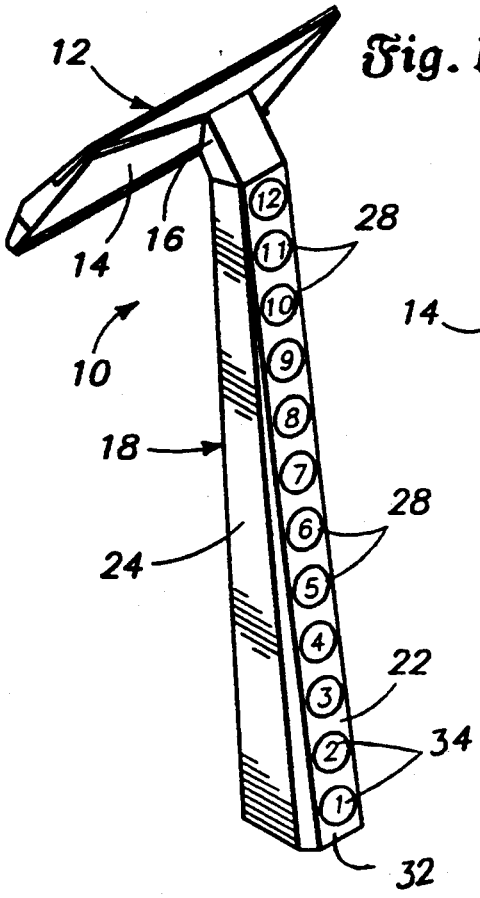
FIG. 1 is an elevated perspective view of the present invention.

The disposable shaver comprising the present invention is designated generally by the reference numeral 10 in FIG. 1 through 4. Shaver 10 is comprised of shaver head 12 having blade 14, a neck 16 and a handle 18.

Figure 2:
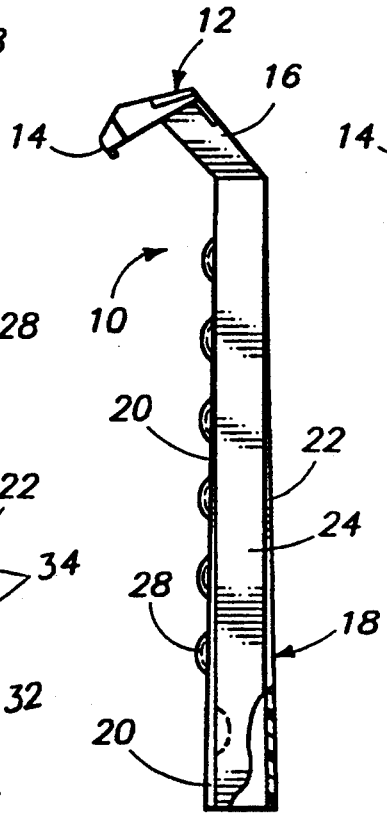
FIG. 2 is a side view of the present invention shown with the blisters formed on the front side of the handle.
Figure 5:
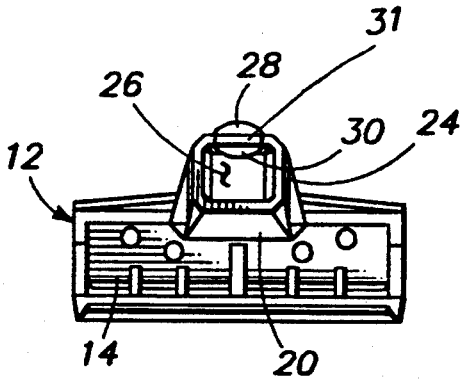
FIG. 5 is an end view of the present invention taken in the direction of the arrow of FIG. 4.

Handle 18 which may be made of high strength plastic, has a front 20 opposite back 22, and sides 24 which define a hollow interior 26 as best seen in FIGS. 2 and 5.

Figure 3:
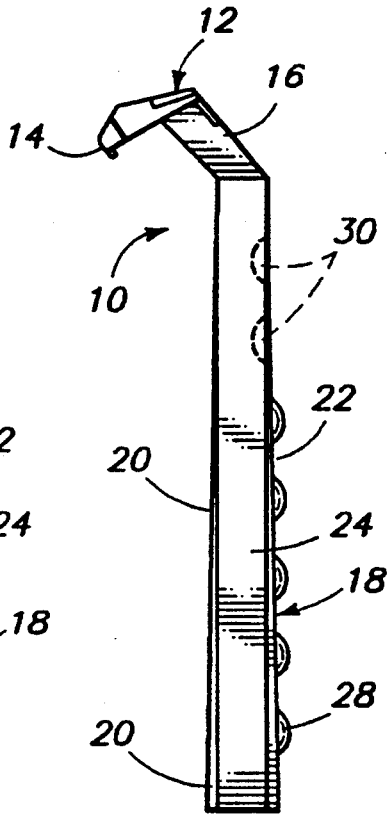
FIG. 3 is a side view of the present invention shown with a straight neck and having the blisters on the backside of the handle of the present invention.
Figure 4:
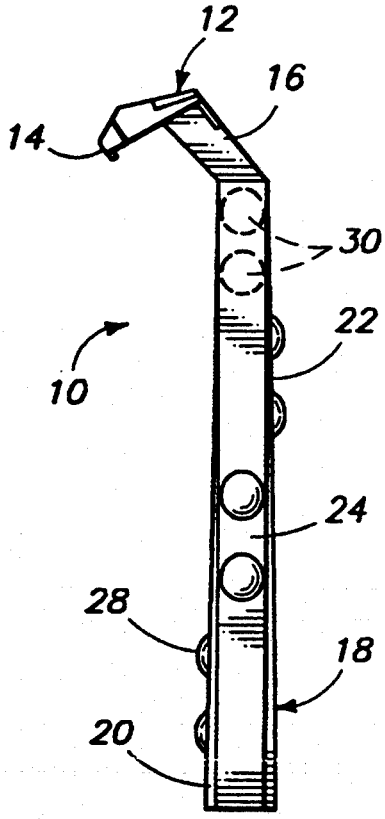
FIG. 4 is a side view of an alternate embodiment of the invention shown in FIG. 1 having a number of the blisters depressed.

Blisters 28 are positioned along the handle. As best seen in FIG. 2, the blisters 28 are shown on the front 20 of the handle 18. As best seen in FIG. 3, blisters 28 are show on the back 22 of the handle 18. As best seen in FIG. 4, blisters 28 are formed on the front 20, the back 22 and the side 24 of handle 18.

With reference to FIGS. 3 and 4, blisters 28 are shown in the raised convex configuration and in the depressed or concave position 30, each having a hole 31 formed therein to facilitate depression of the blisters. After each shave, the user simply depresses one of the deformable blisters. The blister turns from convex to concave and is designed to remain concave for the remaining life of the shaver. As best shown in FIG. 5, a depressed blister enters the hollow interior 26 in the manner shown.

In an alternate embodiment of the invention, it is contemplated that the blisters 28 may be separate components and still fall within the scope of the invention. That is, an adhesive blister bubble strip designated generally by the reference numeral 32 of FIG. 1 may be applied to the handle of conventional shavers converting them into the invention. Of course, in such configuration, the blisters may simply be air filled bubbles. In this fashion, a single blister may simply be broken to count each shave, instead of merely changing shape from convex to concave. The blisters of this embodiment may resemble the bubbles associated with "bubble wrap" protective packaging materials, and have an adhesive backing for attachment to the shaver handle.

MODE OF OPERATION

The present invention is used to count the number of successful shaves from a given shaver. The inventive apparatus is also used in accordance with the present inventive method. After each shave the user simply applies pressure with the thumb finger or instrument to change the shape of a blister, either flattening it by bursting the air pocket as in the alternate embodiment, or by causing it to change from convex to concave as in the preferred embodiment.

In addition, the present invention is useful as a qualitative means to compare the useful life, as determined by the user, of a given shaver of brand X as compared to the useful life of a given shaver of brand Y.

In all of the foregoing embodiments and methods, the present invention may incorporate indicia 34. Indicia 34 is a supplemental means of counting shaves, and provides a visual confirmation of the count. The indicia may be letters, numbers, symbols or any combination thereof.

Accordingly, because of the many possible variations of the invention, the scope of the invention should not be considered as limited to the specific embodiments depicted and methods of use described in detail. Rather, the proper scope to be accorded to the invention is defined in the claims as appended hereto.

What is claimed is:

1. A disposable shaver, comprising:

a shaving head, a handle extending from said head, a plurality of blister means formed along and integral with said handle for counting the number of times the shaver is used, said blister means having a convex shape enabling the user to depress and change the shape of said blister means from convex to concave after each use of the shaver.

2. The shaver of claim 1 wherein:

at least said handle of said shaver is made of high strength plastic.

3. The shaver of claim 2 wherein:

said handle is hollow.

4. The shaver of claim 1 wherein:

said handle has indicia means for visually confirming the total number of blister means and the number of blister means depressed.

5. The shaver of claim 1 wherein:

said each blister means has a radius.

6. The shaver of claim 5, wherein:

said blister means are spherically convex prior to depression and concave after depression.

7. The shaver of claim 1 wherein:

said shaving head is flexible.

8. An improvement to a disposable shaver having a shaving head, a neck portion, and a handle, wherein the improvement comprises:

a plurality of blister means along said handle of the shaver for counting the number of times the shaver is used, said blister means having a convex shape to enable the user to depress and change the shape of said blister means after each use of the shaver.

9. The shaver of claim 8 wherein:

said handle has indicia means for visually confirming the total number of blister means and the number of blister means depressed.

10. The shaver of claim 8 wherein:

said each blister means has a radius.

11. The shaver of claim 10, wherein:

said blister means are spherically convex prior to depression and concave after depression.

12. The shaver of claim 8 wherein:

said blister means are provided on a separate component attached to said handle of the disposable shaver.

13. The shaver of claim 8 wherein:

the thickness of the material forming said blister means ranges from 0.001 to 0.004 inches.

14. A method of indicating the number of times a disposable shaver having blister means is used to determine the useful life of said disposable shaver, wherein said shaver has a shaving head, a neck region, and a handle, the method comprising the following steps:

selecting a shaver of a first brand determined by a user, said shaver having a plurality of said blister means for counting the number of times the shaver is used, said blister means having a convex shape and being formed along said handle;

shaving with said selected shaver; and depressing said blister means after said shaving step is successfully completed.

15. The method of claim 14, further comprising the following steps:

repeating said shaving step and said depressing step with said selected shaver until the user determines that the useful life of said selected shaver has expired; and counting the number of blister means depressed after the user determines that the useful life of said shaver has expired.

16. The method of claim 15 further comprising the following steps:

selecting a shaver of a second brand different than the first brand, said shaver of the second brand having a plurality of said blister means, and performing and repeating said shaving step and said depressing step until the user determines that the useful life of said shaver of the second brand has expired; and counting the number of blister means depressed on said shaver of said second brand having a useful life that has expired as determined by the user.

17. The method of claim 16, further comprising the following steps:

selecting at least one additional brand of shaver different from previously selected brands, said additional brand having said blister means, performing and repeating said shaving step and said depressing step for each said additional brand, and performing said counting step for each said additional brand.

18. The method of claim 17, further including the step of:

comparing the counts of the number of blister means depressed for each different brand of shaver having a useful life that has expired as determined by the user, enabling the user to decide which shaver provided a longer useful life.

* * * * *